US006940224B2

(12) United States Patent
Park

(10) Patent No.: US 6,940,224 B2
(45) Date of Patent: Sep. 6, 2005

(54) PLASMA DISPLAY PANEL HAVING SPECIFICALLY SPACED HOLES FORMED IN THE ELECTRODES

(75) Inventor: Hun Gun Park, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 94 days.

(21) Appl. No.: 10/338,755

(22) Filed: Jan. 9, 2003

(65) Prior Publication Data

US 2003/0127983 A1 Jul. 10, 2003

(30) Foreign Application Priority Data

Jan. 10, 2002 (KR) ..... 10-2002-0001441
Jan. 19, 2002 (KR) ..... 10-2002-0003195

(51) Int. Cl.[7] ..... H01J 1/62; H01J 63/04
(52) U.S. Cl. ..... 313/505; 313/498
(58) Field of Search ..... 313/572–578, 313/581–587; 315/169.4

(56) References Cited

U.S. PATENT DOCUMENTS 6,160,348 A * 12/2000 Choi ..... 313/584
6,424,095 B1 * 7/2002 Hirao et al. ..... 313/581
6,479,934 B2 * 11/2002 Nishio ..... 313/586
6,522,071 B1 * 2/2003 Park et al. ..... 313/582
6,670,754 B1 * 12/2003 Murai et al. ..... 313/582
6,744,202 B2 * 6/2004 Okigawa et al. ..... 313/586

FOREIGN PATENT DOCUMENTS

JP 08-315735 11/1996

* cited by examiner

*Primary Examiner*—Joseph Williams
*Assistant Examiner*—Peter Macchiarolo
(74) *Attorney, Agent, or Firm*—Fleshner & Kim LLP

(57) ABSTRACT

A plasma display panel with improved discharge uniformity includes first and second electrodes with a plurality of holes formed therein. A distance between the holes formed in the first and second electrodes are set to such that overlap amounts between address electrode and holes are the same in all sub-pixels. In a preferred embodiment, the distance between the holes is set to 1/n of a width of the sub-pixel, where n is an integer greater than or equal to 1.

12 Claims, 6 Drawing Sheets

PLASMA DISPLAY PANEL HAVING SPECIFICALLY SPACED HOLES FORMED IN THE ELECTRODES

BACKGROUND OF THE INVENTION

1. Field of the Invention

The present invention relates to a plasma display panel, and more particularly to a plasma display panel that is adaptive for improving the uniformity of discharge.

2. Description of the Related Art

Recently, there has been developed various flat panel display devices with possible reduction in their weight and size, the weight and size have been the disadvantage of cathode ray tubes CRT. Such flat panel display devices include a liquid crystal display LCD, a field emission display FED, a plasma display panel PDP and an electroluminescence EL panel, etc.

The PDP among these flat panel display devices is a display device using gas discharge and has an advantage that it is easy to be made on a large scale. A typical PDP is a three-electrode AC surface discharge PDP that has three electrodes, as shown in FIG. 1, and is driven by AC voltage.

Referring to FIG. 1, a discharge cell of the three-electrode AC surface-discharge PDP includes a first electrode 12Y and a second electrode 12Z formed on an upper substrate 10, and an address electrode 20X formed on a lower substrate 18.

The first and second electrodes 12Y and 12Z are formed of transparent material in order to transmit the light supplied from the discharge cell. On the rear surface of the first and second electrodes 12Y and 12Z, bus electrodes 13Y and 13Z of metal are formed in parallel with the first and second electrodes 12Y and 12Z. Such bus electrodes 13Y and 13Z are used in order to supply driving signals to the first and second electrodes 12Y and 12Z with high resistance value.

On the upper substrate 10 provided with the first and second electrodes 12Y and 12Z in parallel, there are deposited an upper dielectric layer 14 and a passivation film 16. Wall charges generated upon plasma discharge are accumulated in the upper dielectric layer 14. The passivation film 16 prevents a damage of the upper dielectric layer 14 caused by a sputtering during the plasma discharge and improves the emission efficiency of secondary electrons. This passivation film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a phosphorus 26. The address electrode 20X is formed in a direction crossing the first electrode 12Y and the second electrode 12Z. The barrier ribs 24 are formed in parallel to the address electrode 20X to prevent an ultraviolet ray and a visible light generated by a discharge from being leaked to the adjacent discharge cells.

The phosphorus 26 is excited by the ultraviolet ray generated during the plasma discharge to generate any one of red, green and blue visible light rays. There is an inactive gas for a gas discharge injected into a discharge space defined between upper/lower plates and the barrier ribs, wherein the inactive gas can be He+Ne, He+Xe or He+Ne+Xe etc.

In such a conventional PDP, the first and second electrodes 12Y and 12Z are formed parallel in each discharge cell. The first electrode 12Y is supplied with a reset pulse, a scan pulse and a first sustain pulse. The second electrode 12Y is supplied with a second sustain pulse.

When the reset pulse is applied to the first electrode 12Y, the discharge cells are initialized. When the first electrode 12Y is supplied with the scan pulse, the address electrode 20X is supplied with data pulses synchronized with the scan pulses. At this moment, an address discharge is generated in the discharge cells which is supplied with a scan pulse and a data pulse.

After the address discharge is generated in the discharge cells, the first and second sustain pulses are alternately applied to the first and second electrodes 12Y and 12Z. When the first and second electrodes 12Y and 12Z are supplied with the first and second sustain pulses, there is a sustain discharge generated in the discharge cells where the address discharge is generated. In this sustain discharge, discharge time is determined by gray level values, and a picture is displayed in accordance with the gray level values.

On the other hand, the conventional first and second electrodes 12Y and 12Z occupy a broad area and are formed in parallel in the discharge cells. In this way, if the first and second electrodes 12Y and 12Z occupy a broader area, there is bigger power dissipation. Consequently, there is deterioration in the discharge efficiency of the PDP.

Referring to FIG. 3, the PDP according to another embodiment of the prior art includes an address electrode 32X, a first and a second electrode 31Y and 31Z formed in a direction crossing the address electrode, a first electrode 30Y extended from the first bus electrode 31Y, and a second electrode 30Z extended from the second bus electrode 31Z.

The first electrode 30Y is extended in a 'T' shape from the first bus electrode 31Y. The second electrode 30Z is extended in a 'T' shape from the second bus electrode 31Z. If the first and second electrodes 30Y and 30Z are formed in a 'T' shape, their total area can be reduced while keeping the electrodes long enough. Accordingly, the power dissipation decreases as much as the area of the first and second electrodes 30Y and 30Z is reduced, thereby improving the discharge efficiency. Also, in an example, the PDP with the 'T' shape electrode structure appears to be improved by about 15% in its light emitting efficiency.

Herein, in the conventional PDP with the 'T' shape electrode, the first and second electrodes 30Y and 30Z should be aligned between the barrier ribs 24 accurately. However, there occurs a movement of a few $\mu$m to several tens $\mu$m in the course of joining the upper and lower substrates 10 and 18 of the PDP. If there occurs any movement in the course of joining the upper and lower substrates 10 and 18, the first and second electrodes 30Y and 30Z cannot be formed at the center of the discharge cell as in FIG. 4.

And if the first and second electrodes 30Y and 30Z of a 'T' shape are not formed at the center of the discharge cell, the discharge is not uniformly generated for every cell. Also, there occur no normal address and sustain discharge. Additionally, there is a change caused in a discharge voltage characteristic, and a bad influence is given to a picture quality in the end.

In order to overcome these disadvantage, a PDP as in FIG. 5 has been proposed.

Referring to FIG. 5, the PDP according to still another embodiment of the prior art has at least two holes 42 formed on the first and second electrodes 40Y and 40Z of transparent electrodes. The holes 42 are disposed at regular intervals on the transparent electrode and should not overlap with the bus electrodes 41Y and 41Z.

The PDP according to still another embodiment of the prior art has an advantage of easy alignment as compared with the PDP as in FIG. 3 where the 'T' shape electrode should be located at the center of the discharge cell. And, power dissipation is reduced as much as the area in which the holes 42 are formed, and discharge efficiency is improved accordingly.

However, when the first and second electrodes 40Y and 40Z according to still another embodiment of the prior art are formed in the PDP, the areas where the first and second electrodes 40Y and 40Z overlap with the address electrode 44X are different from one another in the cells. In other words, the holes 42 as in FIG. 6 overlap with the address electrodes 44X in a range of 100%~a few % for each discharge cell. Further, it is possible for the holes 42 not to overlap with the address electrodes 44X.

In this way, if the area where the address electrode 44X overlap with the hole 42 is different for each discharge cell, there occurs a lack of uniformity in the address discharge.

SUMMARY OF THE INVENTION

Accordingly, it is an object of the present invention to provide a plasma display panel that is adaptive for improving the uniformity of discharge.

In order to achieve these and other objects of the invention, a plasma display panel according to an aspect of the present invention includes a first electrode and a second electrode made of transparent material and formed parallel to each other in the sub-pixel; bus electrodes formed parallel to the first and second electrodes on one sides of the first and the second electrodes; and a plurality of holes formed in the first and second electrodes, and wherein a distance between the holes is set to 1/n (n is an integer of 1 or more) of the pixel.

Herein, the holes do not overlap with the bus electrode.

Herein, there is an address electrode formed crossing the first and second electrodes, and an overlapping area between the address electrode and the holes is set the same in all the sub-pixels.

A plasma display panel according to another aspect of the present invention includes a first electrode and a second electrode made of transparent material and formed parallel to each other in the sub-pixel; bus electrodes formed parallel to the first and second electrodes on one sides of the first and the second electrodes; and a plurality of holes formed in the first and second electrodes, and wherein a distance between the holes is set to 1/n (n is an integer of 1 or more) of the sub-pixel.

Herein, the holes do not overlap with the bus electrode.

Herein, there is an address electrode formed crossing the first and second electrodes, and an overlapping area between the address electrode and the holes is set the same in all the sub-pixels.

A plasma display panel according to still another aspect of the present invention includes a first electrode and a second electrode made of transparent material and formed parallel to each other in the sub-pixel; and a plurality of holes formed in the first and second electrodes, and wherein a distance between the holes is set to 1/n (n is an integer of 1 or more) of the sub-pixel.

Herein, the distance between the holes disposed in each of a red sub-pixel, a green sub-pixel and a blue sub-pixel is set to 1/n of the sub-pixel where the holes are formed.

Herein, there is an address electrode formed crossing the first and second electrodes, and an overlapping area between the address electrode and the holes is set the same in all the sub-pixels.

A plasma display panel according to still another aspect of the present invention includes a first electrode and a second electrode made of transparent material and formed parallel to each other in the sub-pixel; and a plurality of holes formed in the first and second electrodes, and wherein a distance between the holes is set to 1/n (n is an integer of 1 or more) of the sub-pixel.

Herein, the distance between the holes disposed in each of a red sub-pixel, a green sub-pixel and a blue sub-pixel is set to 1/n of the sub-pixel where the holes are formed.

Herein, the widths of the holes are set to 1/i (i is an integer of 1 or more) of the address electrode.

Herein, the widths of the holes disposed in each of a red sub-pixel, a green sub-pixel and a blue sub-pixel are set to 1/i of the width of the address electrode formed in the sub-pixel where the holes are formed.

Herein, the address electrode is formed crossing the first and second electrodes, and an overlapping rate between the address electrode and the holes is set the same in all the sub-pixels.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
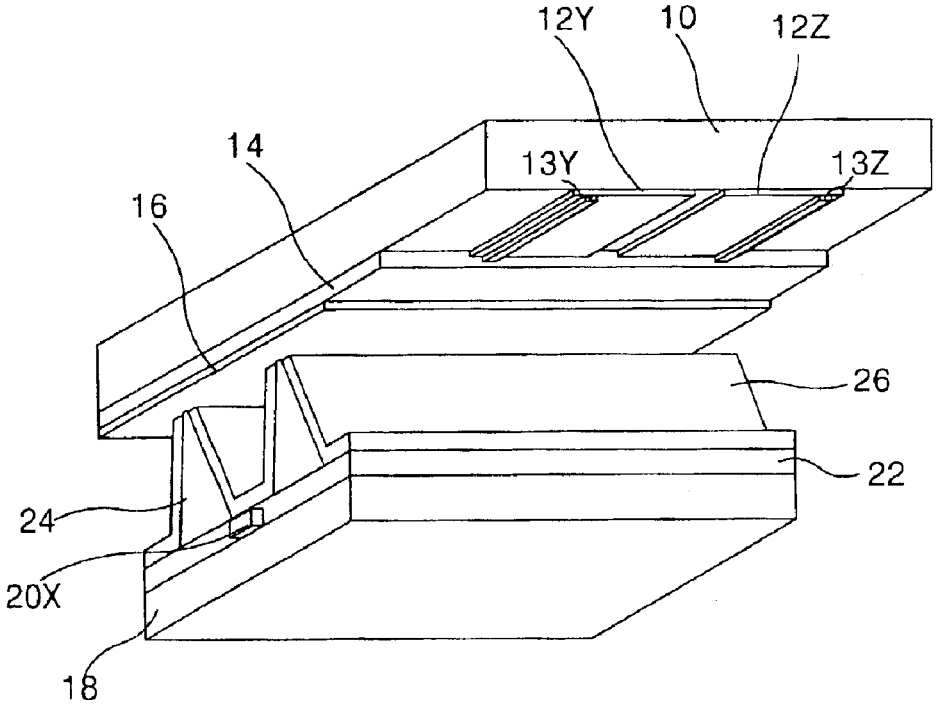
FIG. 1 RELATED ART
FIG. 1 is a perspective view representing a conventional three electrode AC surface discharge plasma display panel.
Figure 2:
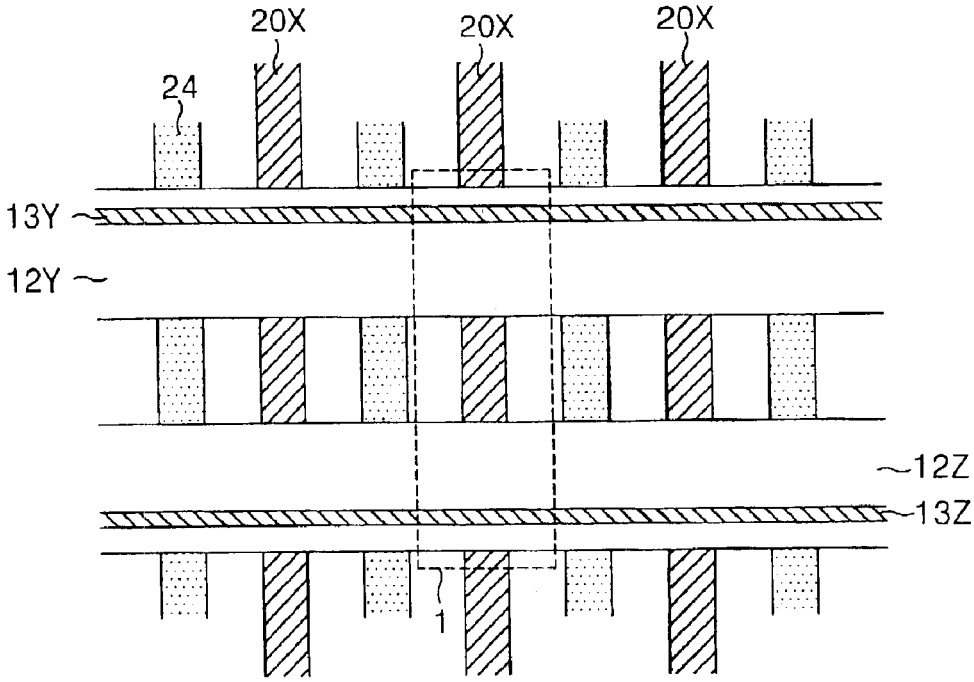
FIG. 2 RELATED ART
FIG. 2 illustrates an electrode structure of the plasma display panel shown in FIG. 1.
Figure 3:
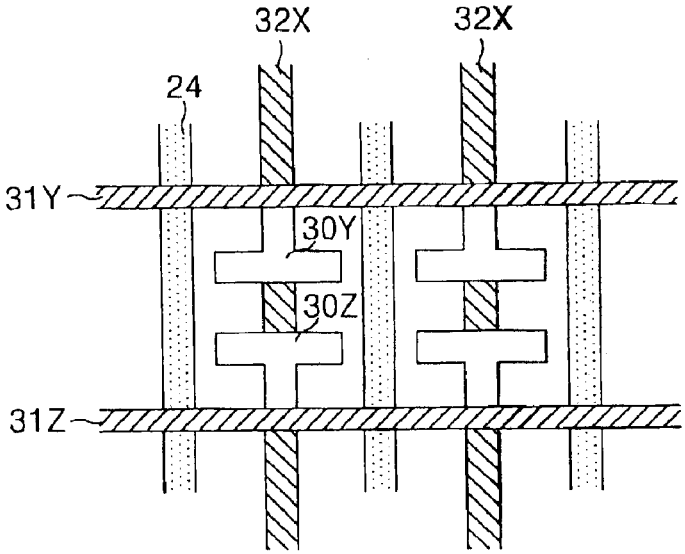
FIG. 3 RELATED ART
FIGS. 3 and 4 illustrate plasma display panels according to another embodiment of the prior art.
Figure 4:
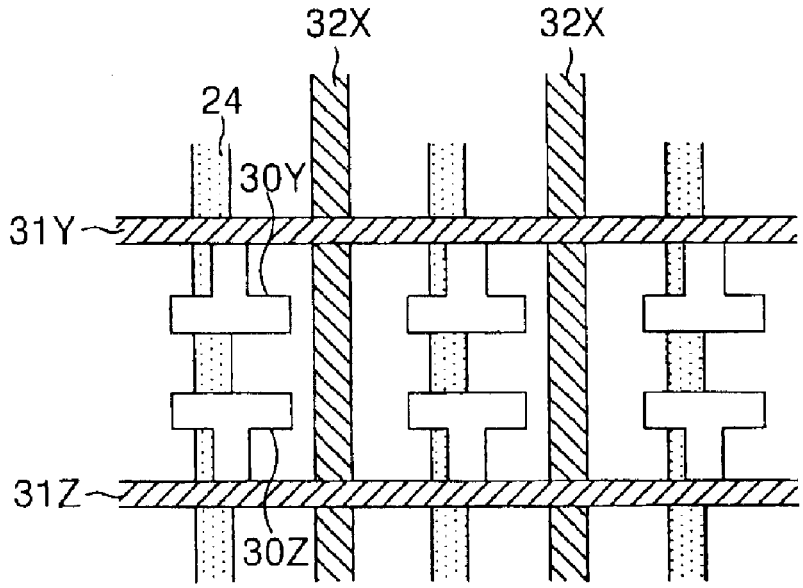
FIG. 4 RELATED ART
Figure 5:
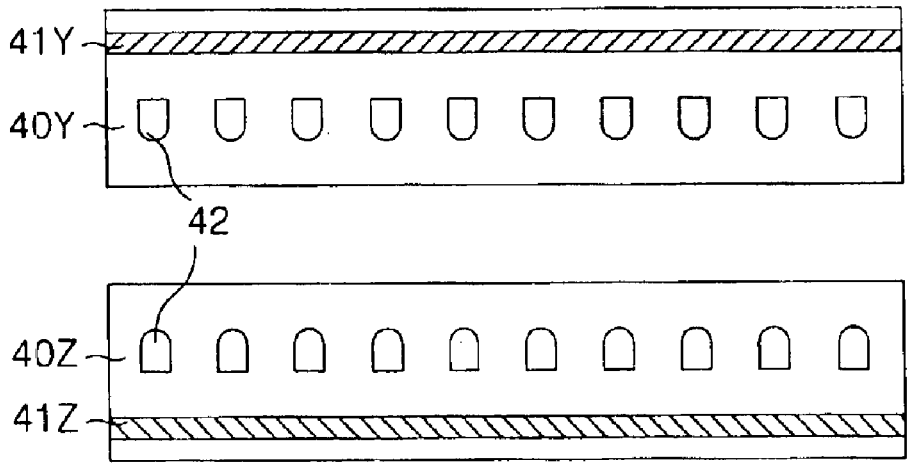
FIG. 5 RELATED ART
FIGS. 5 and 6 illustrate an electrode structure of a plasma display panel according to another embodiment of the related art.
Figure 6:
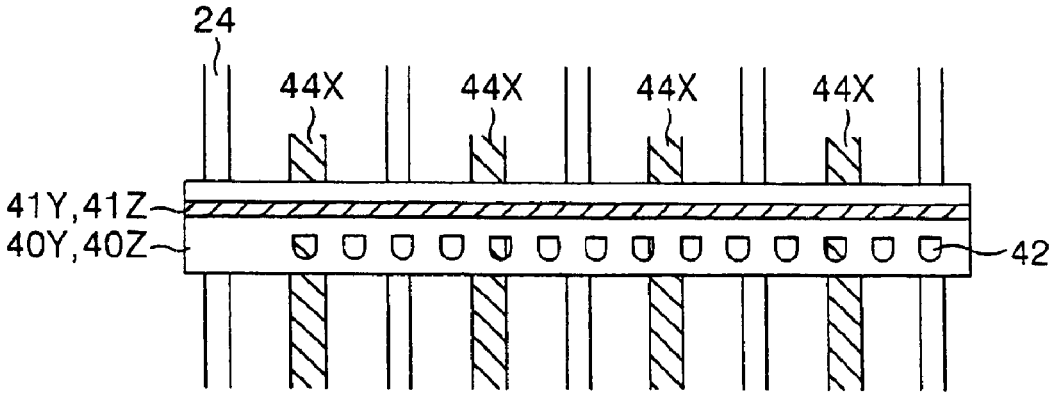
FIG.6 RELATED ART
Figure 7:
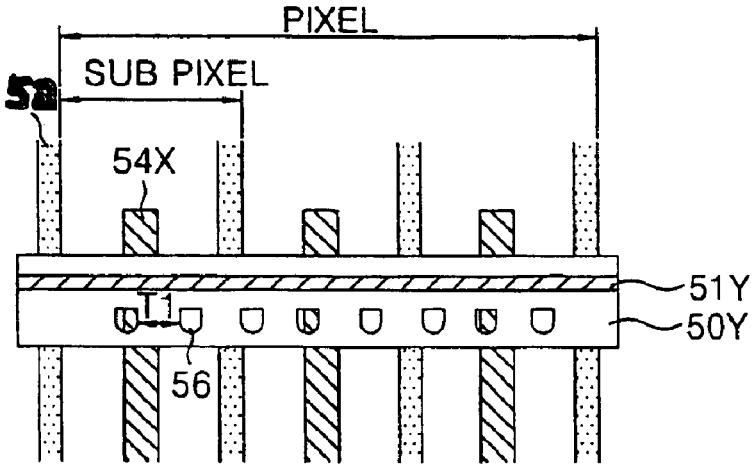
FIGS. 7 and 8 illustrate plasma display panels according to the first embodiment of the present invention.

FIG. 7 illustrates a plasma display panel according to the first embodiment of the present invention. In the PDP shown in FIG. 7, it is assumed that sub-pixels are the same in size regardless of phosphorus materials of red, green and blue.

Referring to FIG. 7, the PDP according to the embodiment of the present invention includes a first electrode 50Y, a bus electrode 51Y formed on one side end of the first electrode 50Y and applying a driving pulse to the first electrode 50Y, an address electrode 54X formed in a direction crossing the first electrode 50Y, barrier ribs 52 formed parallel to the address electrode 54X and preventing ultraviolet ray and visible light generated by a discharge from leaking to an adjacent discharge cell.

The first electrode 50Y is only illustrated in FIG. 7, however actually in a discharge cell, there is a second electrode (not shown) formed in the same shape as the first electrode as well as parallel to the first electrode.

There are a plurality of holes 56 formed in the first electrode 50Y by the embodiment of the present invention. Since holes 56 are formed in the first electrode 50Y, its power dissipation is reduced as much as the area where the holes 56 are formed and its discharge efficiency is improved accordingly.

On the other hand, the distance T1 of the holes 56 is set to 1/n (n is an integer of 1 or more) of the sub-pixel, i.e., discharge cell of red, green or blue. In this way, if the distance T1 between the holes 56 is set to 1/n of the sub-pixel, the area where the address electrode 54X overlap with the first electrode 50Y becomes identical in all discharge cells as in FIG. 7.

Figure 8:
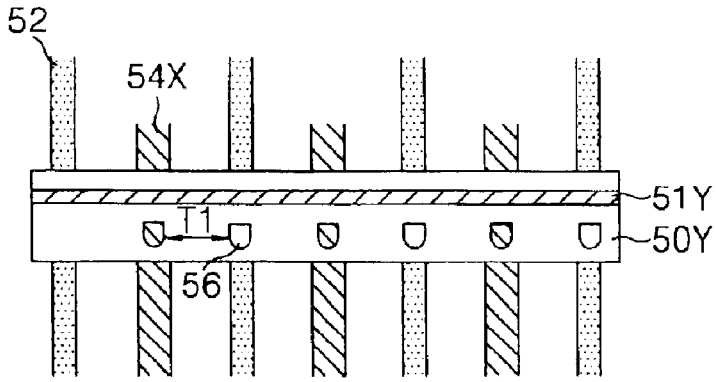

In other words, if the distance T1 between holes 56 is set to 1/n, the holes 56 are disposed at the rate of the sub-pixels. Accordingly, if the hole 56 is disposed partially overlapping with the address electrode 54X in a specific cell, the hole 56 is disposed partially overlapping with the address electrode 54X in all other cells. Also, if the hole 56 is disposed completely overlapping with the address electrode 54X in a specific cell as in FIG. 8, the hole 56 is disposed completely overlapping with the address electrode 54X in all other cells.

Like this in the present invention, the area where the address electrode 54X overlap with the first electrode 50Y becomes identical in all discharge cells, thus the uniformity of the address discharge can be assured.

On the other hand, in the present invention, the distance T1 between the holes 56 can be set to 1/n of a pixel consisting of discharge cells of red, green and blue. If the distance between the holes 56 is set to 1/n of the pixels, the area where the address electrode 54X overlap with the first electrode 50Y becomes identical in all discharge cells, thus the uniformity of the address discharge can be assured.

Figure 9:
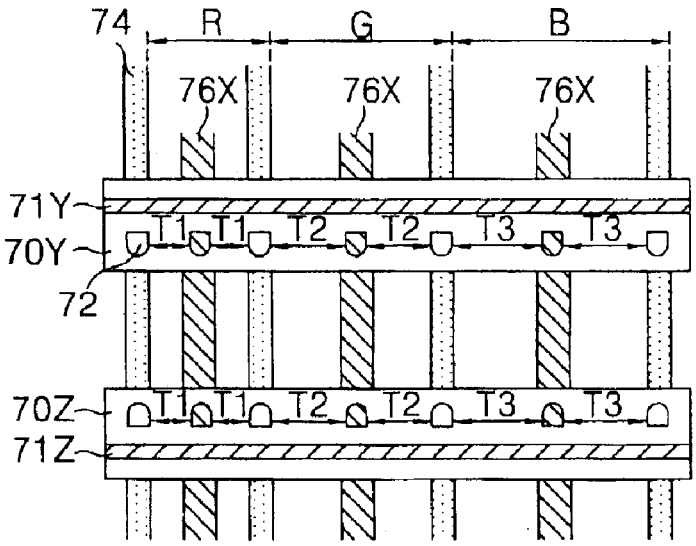
FIGS. 9 and 10 illustrate plasma display panels according to the second embodiment of the present invention.

FIG. 9 illustrates a plasma display panel according to the second embodiment of the present invention.

Referring to FIG. 9, a PDP according to the second embodiment of the present invention has the size of the sub-pixels R, G and B set differently for each of phosphorus materials of red, green and blue. The PDP of the present invention includes a first electrode 70Y and a second electrode 70Z; a first bus electrode 71Y and a second bus electrode 71Y and 71Z formed on one side end of the first and second electrodes 70Y and 70Z and receiving a driving pulse from the outside; an address electrode 76X formed in a direction crossing the first and second electrodes 70Y and 70Z; and barrier ribs 74 formed parallel to the address electrode 76X and preventing the ultraviolet ray and visible light generated by a discharge from leaking to an adjacent discharge cell.

In the PDP of the present invention, the first and second electrodes 70Y and 70Z are formed parallel to each other. The first electrode 70Y receives a reset pulse, a scan pulse and a first sustain pulse. The second electrode 70Z receives a second sustain pulse.

There are discharge cells initialized when the reset pulse is applied to the first electrode. When the first electrode 70Y is supplied with the scan pulse, the address electrode 76X is supplied with a data pulse synchronized with the scan pulse. At this moment, the address discharge is generated in the discharge cells to which the scan pulse and the data pulse are applied.

After the address discharge being generated in the discharge cells, the first and second electrodes 70Y and 70Z are alternately supplied with the first and second sustain pulses. If the first and second electrodes 70Y and 70Z are supplied with the first and second sustain pulses, the sustain discharge is generated in the discharge cells where the address discharge has been generated. In such a sustain discharge, its discharge time is determined by a gray level value, and a picture is displayed in accordance with the gray level value.

In the second embodiment of the present invention, there are a plurality of holes 72 formed in the first and second electrodes 70Y and 70Z. Like this, since the holes 72 are formed in the first and second electrodes 70Y and 70Z, the power dissipation is reduced as much as the area where the holes 72 are formed, and there is an improvement in discharge efficiency accordingly.

On the other hand, a distance between the holes 72 is set to 1/n (n is an integer of 1 or more) of the sub-pixel of R, G and B.

In other words, the holes 72 formed in an R sub-pixel as in FIG. 7 are disposed with the distances T1 therebetween being 1/n of the R sub-pixel. The holes 72 formed in a G sub-pixel are disposed with the distances T2 therebetween being 1/n of the G sub-pixel. And, the holes 72 formed in an B sub-pixel are disposed with the distances T3 therebetween being 1/n of the B sub-pixel.

If the holes 72 are disposed with the distance therebetween being 1/n of the sub-pixel in which they are formed, the area where the address electrode 76X overlap with the first electrode 70Y and/or the second electrode 70Z becomes identical in all discharge cells.

In other words, if the distances T1, T2 and T3 between the holes 72 are set to 1/n of the sub-pixels where they are formed, the holes 72 are disposed at the rate of the sub-pixels. Accordingly, if the hole 72 is disposed overlapping with the address electrode 76X in a specific cell, the hole 72 is disposed overlapping with the address electrode 76X in all other cells.

Figure 10:
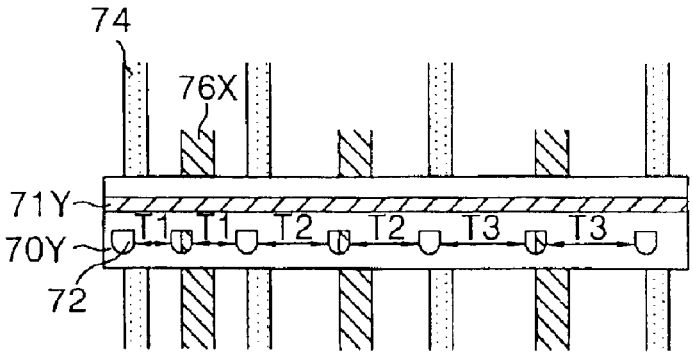

On the other hand, the overlapping rate of the holes 72 and the address electrode 76X is the same in all discharge cells even though there is any movement of the first electrode 70Y and/or the second electrode 70Z in the course of joining an upper substrate and a lower substrate (not shown). In other words, even though the first electrode 70Y is moved within a specific $\mu$m in the course of joining the upper and lower substrates of the first electrode 70Y, the overlapping rate of the first electrode 70Y and the address electrode 76X as in FIG. 10 are set the same in all the discharge cells.

In the second embodiment of the present invention, the area where the address electrode 76X overlap with the first electrode 70Y becomes identical in all discharge cells, thus the uniformity of the address discharge can be assured.

Figure 11:
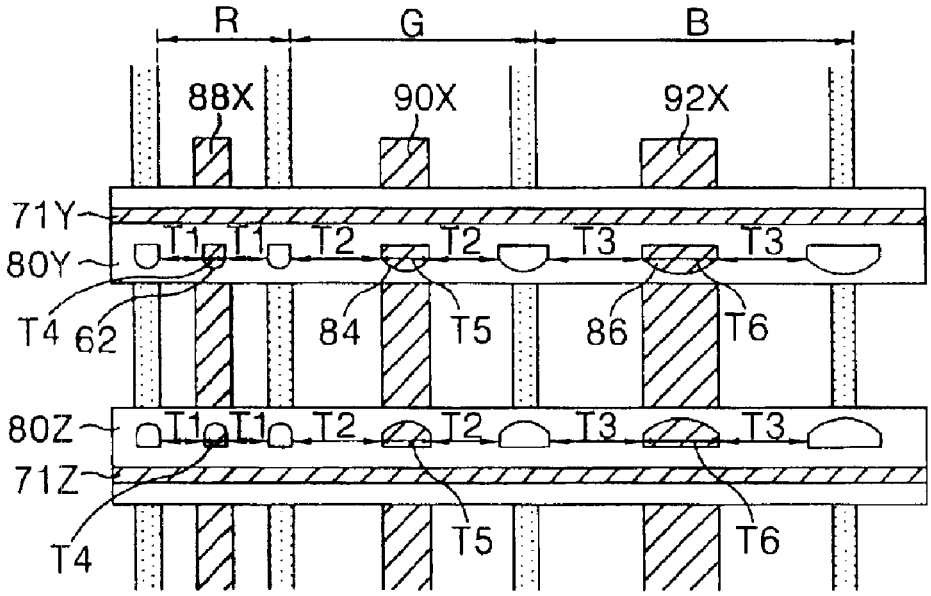
FIGS. 11 and 12 illustrate plasma display panels according to the third embodiment of the present invention.

FIG. 11 illustrates a plasma display panel according to the third embodiment of the present invention.

Referring to FIG. 11, a PDP according to the third embodiment of the present invention has the size of the sub-pixels R, G and B and the width of address electrodes 88X, 90X and 92X set differently for each of phosphorus materials of red, green and blue. That is, the size of the sub-pixels are set in order of B sub-pixel>G sub-pixel>R sub-pixel. Similarly, the width of the address electrode 92X formed in the B sub-pixel is set to be wider than that of the address electrode 90X formed in the G sub-pixel. Also, the width of the address electrode 90X formed in the G sub-pixel is set to be wider than the address electrode 88X formed in the R sub-pixel.

There are a plurality of holes 82, 84 and 86 formed in the first and second electrodes 80Y and 80Z of the PDP according to the second embodiment of the present invention. Since the holes 82, 84 and 86 are formed in the first and second electrodes 80Y and 80Z in this way, its power dissipation is reduced as much as the area where the holes 82, 84 and 86 are formed and there is an improvement in its discharge efficiency accordingly.

On the other hand, in this invention, the width of the holes 82, 84 and 86 are set to 1/i (i is an integer of 1 or more) of the sub-pixel where they are formed. Accordingly, the width T5 of the holes 84 disposed in the G sub-pixel is set to be wider than the width T4 of the holes 82 disposed in the R sub-pixel. Also, the width T6 of the holes 86 disposed in the B sub-pixel is set to be wider than the width T5 of the holes 84 disposed in the G sub-pixel.

Herein, distances between the holes 82, 84 and 86 are set to 1/n (n is an integer of 1 or more) of the sub-pixel where the holes are formed. In other words, the holes 82 formed in an R sub-pixel are disposed with the distances T1 therebetween being 1/n of the R sub-pixel. The holes 84 formed in a G sub-pixel are disposed with the distances T2 therebetween being 1/n of the G sub-pixel. And, the holes 86 formed in an B sub-pixel are disposed with the distances T3 therebetween being 1/n of the B sub-pixel.

If the holes 82, 84 and 86 are disposed with the distance therebetween being 1/n of the sub-pixel in which they are formed and if the sizes of the holes 82, 84 and 86 are set correspondingly to the widths of the address electrodes 88X, 90X and 92X where the holes are formed, the ratio that the first and second electrodes 80Y and 80Z overlap with the address electrodes 88X, 90X and 92X becomes identical in all discharge cells.

On the other hand, the overlapping rate of the holes 82, 84 and 86 and the address electrodes 88X, 90X and 92X is the same in all discharge cells even though there is any movement of the first electrode 80Y and/or the second electrode 80Z in the course of joining an upper substrate and a lower substrate (not shown).

Figure 12:
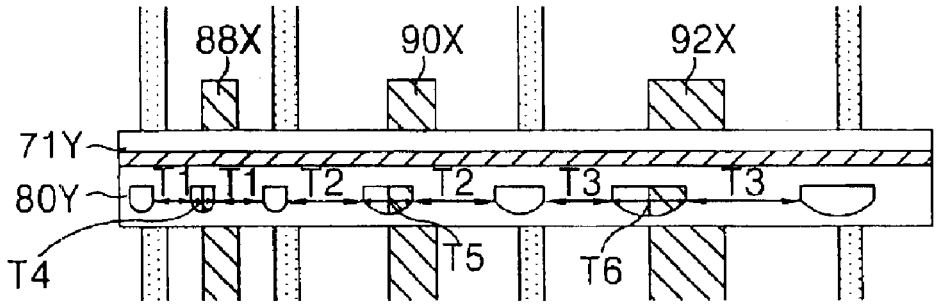

In other words, even though the first electrode 80Y is moved within a specific $\mu$m in the course of joining the upper and lower substrates of the first electrode 70Y, the overlapping rate of the first electrode 80Y and the address electrode 88X, 90X and 92X as in FIG. 12 are set the same in all the discharge cells.

As described above, in the plasma display panel according to the present invention, the distances between holes formed in the first and second electrodes are set to 1/n of the sub-pixel. If the distance between holes is set to 1/n of the sub-pixel, the area where the first and second electrodes overlap with the address electrode is the same in all the discharge cells. The present invention can assure the uniformity of the discharge by keeping the overlapping area of the first and second electrodes and the address electrode the same in all discharge cells.

Also, it is possible to assure the overlapping area of the first and second electrodes and the address electrode the same in all the discharge cells by having the width of the holes changed correspondingly to the width of the address electrode.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel comprising a plurality of sub-pixels, wherein at least two of the sub-pixels are of different size, comprising:

a first electrode and a second electrode made of transparent material and formed parallel to each other; and a plurality of holes formed in the first and second electrodes, wherein a distance between holes positioned in a sub-pixel is 1/n of a width of the sub-pixel, wherein n is an integer greater than or equal to 1.

2. The plasma display panel according to claim 1, wherein the plurality of sub-pixels comprise a plurality of red, green and blue sub-pixels, and a width of the red sub-pixels is different than a width of the green and/or blue sub-pixels.

3. The plasma display panel according to claim 1, further comprises an address electrode positioned so that it crosses the first and second electrodes, and so that an overlapping area between the address electrode and the holes is the same in all the sub-pixels.

4. A plasma display panel in which a width of at least any one of a red sub-pixel, a green sub-pixel and a blue sub-pixel and a width of at least one address electrode are set differently, comprising:

a first electrode and a second electrode made of transparent material and formed parallel to each other; and a plurality of holes formed in the first and second electrodes, wherein a distance between holes positioned in a sub-pixel is 1/n of the width of the sub-pixel, wherein n is an integer greater than or equal to 1.

5. The plasma display panel according to claim 4, wherein a width of the red sub-pixel is different than a width of the green and/or blue sub-pixel.

6. The plasma display panel according to claim 4, wherein the widths of the holes positioned in the sub-pixel are 1/i of the width of an address electrode that crosses the sub-pixel, wherein i is an integer greater than or equal to 1.

7. The plasma display panel according to claim 6, wherein the widths of the holes positioned in each of a red sub-pixel, a green sub-pixel and a blue sub-pixel are 1/i of the width of the address electrode that crosses the respective sub-pixel where the holes are positioned.

8. The plasma display panel according to claim 7, wherein the address electrode is positioned such that it crosses the first and second electrodes, and an overlapping rate between the address electrode and the holes is set the same in all the sub-pixels.

9. A plasma display panel comprises a plurality of sub-pixels, wherein at least two of the sub-pixels are of different size, comprising:

first and second electrodes positioned parallel to each other; and a plurality of holes formed in the first and second electrodes, wherein distances between the holes in the first and second electrodes are set such that an overlap amount between an address electrode and holes positioned in a sub-pixel is the same as the overlap amount between an address electrode and holes positioned in all other sub-pixels.

10. The plasma display panel according to claim 9, wherein a distance between holes positioned in a sub-pixel is 1/n of a width of the sub-pixel, wherein n is an integer greater than or equal to 1.

11. The plasma display panel according to claim 9, wherein a width of holes positioned in a sub-pixel is 1/i of the width of an address electrode that crosses the sub-pixel.

12. The plasma display panel according to claim 11, wherein the holes positioned in the sub-pixel have the same width as the address electrode that crosses the sub-pixel.

* * * * *